United States Patent [19]

Gerlach

[11] 3,957,404

[45] May 18, 1976

[54] VANES FOR FLUID POWER CONVERTER

[75] Inventor: Charles R. Gerlach, San Antonio, Tex.

[73] Assignee: Rineer Hydraulics, Inc., Corpus Christi, Tex.

[22] Filed: Mar. 13, 1975

[21] Appl. No.: 558,088

[52] U.S. Cl. ..... 418/150; 418/221

[51] Int. Cl.[2] ..... F01C 1/00; F03C 3/00; F04C 1/00

[58] Field of Search ..... 418/150, 221, 248, 266

[56] References Cited

UNITED STATES PATENTS

| | | | |
|---|---|---|---|
| 868,841 | 10/1907 | Calkins | 418/266 |
| 3,609,071 | 9/1971 | Brown | 418/221 |

FOREIGN PATENTS OR APPLICATIONS

| | | | |
|---|---|---|---|
| 466,779 | 8/1914 | France | 418/221 |
| 168,727 | 9/1921 | United Kingdom | 418/221 |

*Primary Examiner*—John J. Vrablik
*Attorney, Agent, or Firm*—Fulbright & Jaworski

[57] ABSTRACT

In a fluid power converter, such as a hydraulic pump or motor, having a rotor and stator with vanes in both the rotor and stator, the improvement in the vanes which are generally rectangular in cross section in which the outer edges of the vanes have a convex curvature of an extent to prevent the sides of the vanes of the rotor and stator from locking on one another upon rotation. However, the curvature is limited to avoid undesirable detenting as the rotor vanes cross the stator vanes. In addition, the maximum slope of the convex curvature is equal to or exceeds the maximum slope of the peripheral surface on the rotor or stator with which the vanes coact to prevent having sharp corners on the vanes which would engage the stator and rotor peripheries and produce rapid wearing of the vanes as well as the peripheries of the stator and rotor which they contact.

The radial extent of the convex shape of the stator vanes plus the radial extent of the convex shape of the rotor vanes is provided for being at least equal to the minimum radial clearance between the rotor and stator thereby preventing the rotor and stator vanes from catching on each other during rotation. In addition, the radial extent of the convex shape of the stator vanes plus the radial extent of the convex shape of the rotor vanes is no greater than twice the minimum radial clearance between the rotor and stator thereby preventing undesired detenting between the rotor and stator vanes during rotation.

4 Claims, 5 Drawing Figures

MAXIMUM SLOPE = TANGENT $\alpha = \frac{t/2}{R} = \frac{t}{2R}$ $R^2 = (R-F)^2 + (t/2)^2 \Rightarrow R = \frac{t^2}{8F} + \frac{F}{2}$ $F = R - R \cos. \alpha$

MINIMUM VANE EDGE SLOPE = MAXIMUM TANGENT α

VANES FOR FLUID POWER CONVERTER

BACKGROUND OF THE INVENTION

Hydraulic motors and pumps having vane elements in both the rotor and stator are old as shown in Pat. No. 3,672,797. However, for a successful and long-life operation, such fluid power converters depend upon a proper interaction or crossing of the stator and rotor vanes. It has been found that the shape and size of the rotor and stator vane tips or crossing edges are an important influence on successful vane crossings. Because it is a practical impossibility to produce a commercial fluid power converter with zero radial clearance between the rotor and stator adjacent the vane slots, some convex curvature of the rotor and stator vanes is required to prevent the sides of the vanes from locking one on the other in the clearance space between the rotor and stator. While circular vanes, such as shown in Pat. No. 2,992,616 prevent the stator and rotor vanes from locking their excessive curvature creates undesirable detenting action, particularly under conditions of either high speeds or heavy loads as well as causing high friction losses. Additionally, it has been found that it is undesirable to have any coacting contours between the rotor and stator with the vanes which includes any sharp surfaces which undesirably produces rapid wearing of the vanes and their coacting surfaces on the rotor and stator.

Therefore, the present invention provides for improvements in the shape and size of rotor and stator vane tips or crossing edges which prevent vane locking, detenting, and minimizes wear.

SUMMARY

The present invention is directed to the improvement in the configuration and size of the outer edges or tips of the vanes in a fluid power converter having a rotor member and stator member with radially extending vanes in each of the members in which the vanes are generally rectangular in cross section and the outer edges or tips of the vanes extend into the annular space between the rotor and stator and have a convex curved shape.

Furthermore, the radial extent of the convex shape of the stator vanes plus the radial extent of the convex shape of the rotor vanes is made to be at least equal to the minimum radial clearance between the rotor and stator thereby preventing the rotor and stator vanes from locking on each other during rotation.

Yet a further object of the present invention is the provision of providing that the radial extent of the convex shape of the stator vanes is no greater than one fourth of the stator vane thickness, and that the radial extent of the convex shape of the rotor vanes is no greater than one fourth of the rotor vane thickness thereby preventing undesirable detenting between the rotor and stator vanes during rotation.

Yet a still further object of the present invention is the elimination of sharp and/or high friction contact surfaces between the outer edges of the vanes and the coacting peripheries of the stator and rotor by insuring that the maximum slope of the convex shape of the rotor vanes is at least equal to the maximum slope of the stator periphery adjacent the annular fluid space, and that the maximum slope of the convex shape of the stator vanes is at least equal to the maximum slope of the rotor periphery adjacent the annular fluid space.

Still a further object of the present invention is wherein the convex shape of the outer edges of the rotor and stator vanes are arcs of circles.

Yet a still further object of the present invention is the improved configuration of the outer edges of the rotor and stator vanes for use in a fluid power converter in which at least one of the rotor and stator peripheries forming the annular space between the rotor and stator is a harmonic curve.

Yet still a further object of the present invention is the provision of an improved shaped vane for use in a fluid power converter in which at least one of the rotor and stator peripheries is a harmonic curve and the outer edges of the vanes are arcs of circles in which the harmonic curve is defined by a radius $r$ from the center of the converter which is a function of an angle B about the center, the maximum slope of the arc of the circle of the vane engaging the harmonic curve forms a slope angle $\alpha$ and the tangent $\alpha$ is at least as great as $$\frac{1}{r} \quad \frac{dr}{dB}$$

wherein the vane engaging the harmonic curve has a thickness $t$ and its circular arc convex shape has a radius R whereby $$R = \frac{t}{2 \operatorname{Tan} \alpha}$$

and the radial extent F of the vane equals $R - R \cos \alpha$.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

While the improved vanes of the present invention will be described in use in a fluid power converter shown in Pat. No. 3,782,867 for purposes of illustration only, the vanes of the present invention may be utilized in other and various types of fluid power converters.

Figure 1:
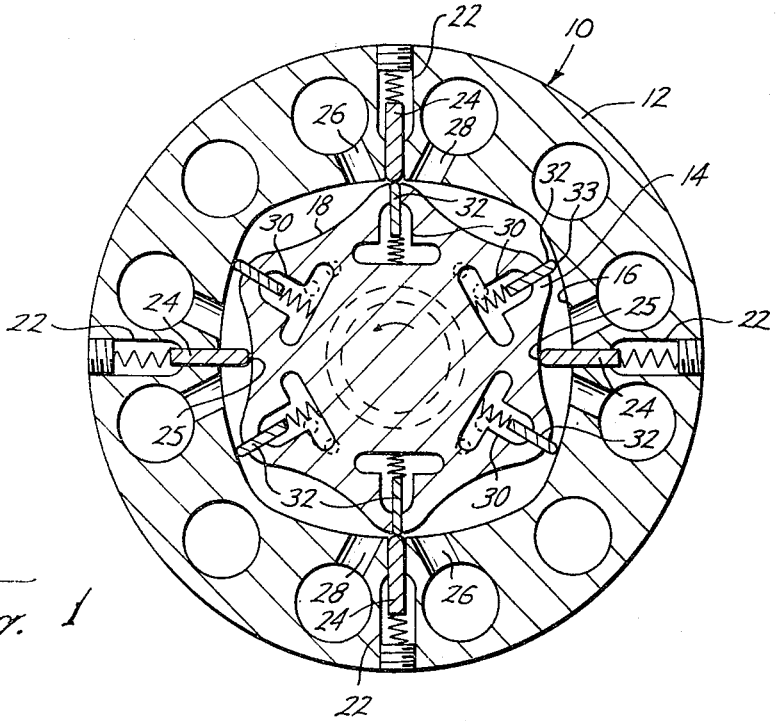
FIG. 1 is a schematic elevational view, in cross section, illustrating a fluid power converter utilizing the improved vanes of the present invention.
Figure 2:
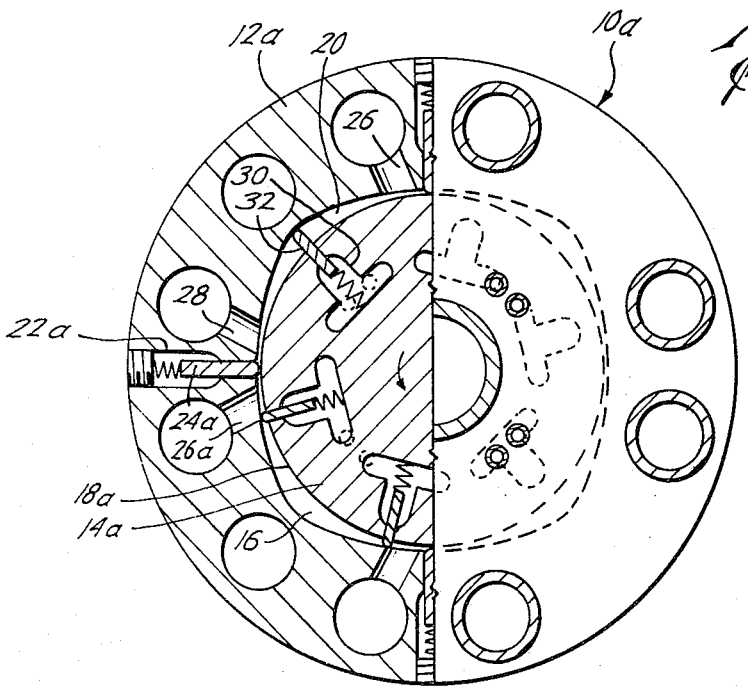
FIG. 2 is a schematic elevational view showing another type of fluid power converter having a round rotor utilizing the improved vanes of the present invention.

Referring now to the drawings, and particularly to FIG. 1, the reference numeral 10 generally indicates a fluid power converter, for example, a hydraulic motor or pump in which the member 12 may be the stator and the member 14 may be the rotor wherein the inner periphery 16 of the stator 12 and the outer periphery 18 of the rotor 14 may be suitably contoured, such as by harmonic curves, to provide an annular fluid space 20 therebetween. The stator 12 includes a plurality of radially extending vane slots 22 each of which receives a vane element 24 therein whose outer edge or tip 25 contacts the outer periphery 18 of the rotor 14. The rotor 14 also includes radially extending vane receiving slots 30 which receives vane elements 32 therein having an outer edge or tip 33 which engages the inner periphery 16 of the stator 12. Thus, assuming fluid comes in the fluid inlet passages 26, and out the passages 28, the rotor 14 will rotate counterclockwise relative to the stator 12. Either the stator inner periphery 16 or the rotor outer periphery 18 may be non-contoured, that is, of a circular configuration, as best seen in FIG. 2, which shows a modified fluid converter 10*a*, having a circular rotor 14*a*. For a more complete description of the fluid power converters of FIGS. 1 and 2, reference is made to Pat. No. 3,782,867.

Figure 3:
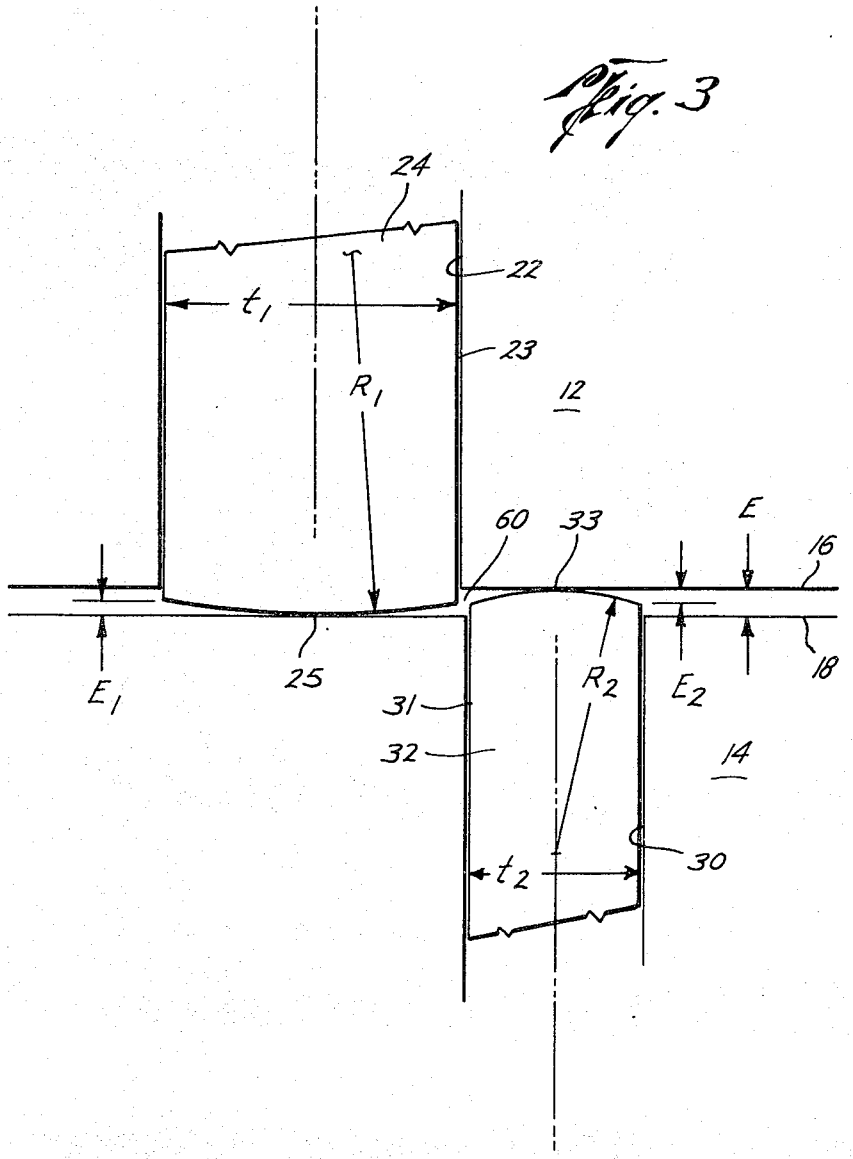
FIG. 3 is an enlarged fragmentary cross-sectional view illustrating a rotor and a stator vane of the present invention just prior to crossing each other during rotation.

Referring now to FIG. 3, the vanes 24 and 32 are shown in position just prior to crossing each other as the vanes 24 and 32 approach one another. Because it is a practical impossibility to commercially produce a fluid power converter 10 with no radial clearance between the rotor 14 and the stator 12 there exists a radial space 60 providing a separation E between the stator inner periphery 16 and the rotor outer periphery 18 when the slots 22 and 30 are adjacent one another. Because of the separation E, a convex curvature of the vane edges or tips 25 and 33 of the vanes 24 and 32, respectively, is required to prevent the sides 23 of the vane 22 and the sides 31 of vane 32 from catching or locking one on the other in the clearance space 60. The vane 24 is shown having a symmetrical convex tip shape 25, here shown as a portion of a circle with a radius $R_1$ although other symmetrical convex curved shapes will also be satisfactory. The radial extent of the convex shape of the outer edge 25 is indicated as $E_1$. Similarly, the vane 32 has a convex curved edge 33, here shown as a portion of a circle with a radius $R_2$, having a radial extent of $E_2$.

As previously mentioned, it is not practical to produce a fluid power converter with a zero radial clearance E between the peripheries 16 and 18 of the rotor 14 and the stator 12, respectively. A value of E equal to a few thousandths of an inch is typical. Therefore, in order to prevent the vanes 24 and 32 from locking as they cross each other, the sum of the radial extents $E_1$ and $E_2$ must equal or exceed the value of the clearance E. That is, $E_1$ plus $E_2$ must equal or exceed E or the vanes will hang upon each other preventing rotation.

Preferably, the vane 24 is shown having a thickness $t_1$ which is somewhat greater than the thickness $t_2$ of the vane 32 as disclosed in Pat. No. 3,782,867. However, for long life of the vane edges 25 and 33 under all conditions or speed and load, the vane edges must be prevented from detenting into the opposing vane slots. While this can be partially accomplished, as described in Pat. 3,782,867, by having one vane somewhat thicker than the other and with the thicker vane always having a greater spring and pressure force pushing it into the opposing periphery, and by hydraulically locking the fluid under one of the vanes during crossing, the detenting action can be reduced by making the values $E_1$ and $E_2$ as small as possible. It has been found that the radial extent $E_1$ of the stator vanes should be no greater than one fourth the thickness $t_1$ of the stator vanes 24, and the radial extent $E_2$ of the rotor vanes 32 should be no greater than one fourth the thickness $t_2$ of the rotor vanes 32 in order to prevent undesirable detenting between the rotor and stator vanes during rotation. It is noted that the convex shape 25 of the stator vanes 24 forms a discontinuous surface with the inner periphery 16 of the stator 12 and the convex shape 33 of the rotor vanes 32 forms a discontinuous surface with the outer periphery 18 of the rotor.

Assuming the tip configurations of FIG. 3 are portions of a circle as shown, but not necessarily required, the values of $R_1$ and $R_2$ may be mathematically related to the vane thicknesses $t_1$ and $t_2$ and the values of $E_1$ and $E_2$ as hereafter described.

Figure 4:
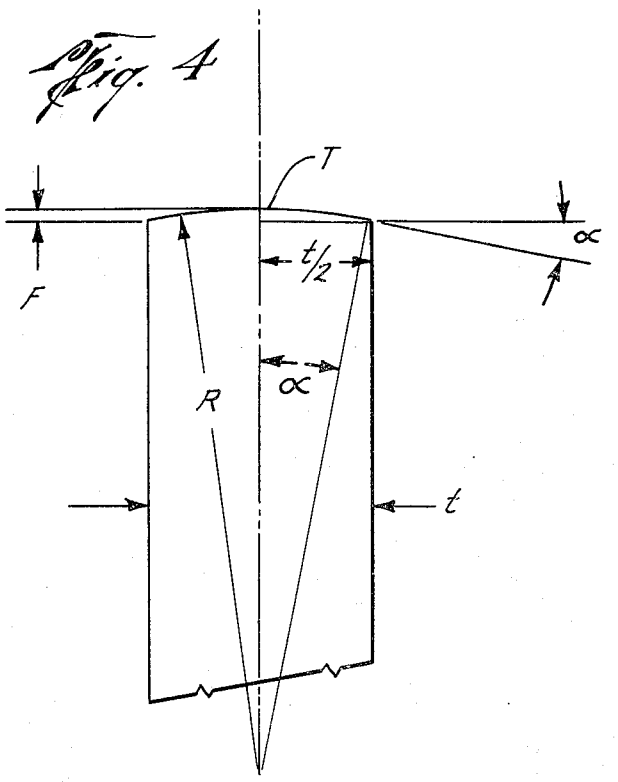
FIG. 4 is an enlarged fragmentary cross-sectional view of one of the vanes of the present invention.

FIG. 4 illustrates the edge or tip geometry for a vane with rounded tip. The maximum slope of the vane tip occurs at the vane corner where a tangent line makes an angle $\alpha$ with a line perpendicular to the vane centerline. The slope of the vane tip T at this point equals the tangent of $\alpha$, or $$\text{Maximum slope} = \text{Tangent } \alpha = \frac{t}{2R}$$

The value of tip radius R may be related to the value of F, the axial extent of the convex tip, and vane thickness $t$ by examining the right triangle with sides $t/2$ and (R—F) and hypotenuse R, from which we have $$R^2 = (R - F)^2 + (t/2)^2$$

thus $$R = \frac{t^2}{8F} + \frac{F}{2}$$

Figure 5:
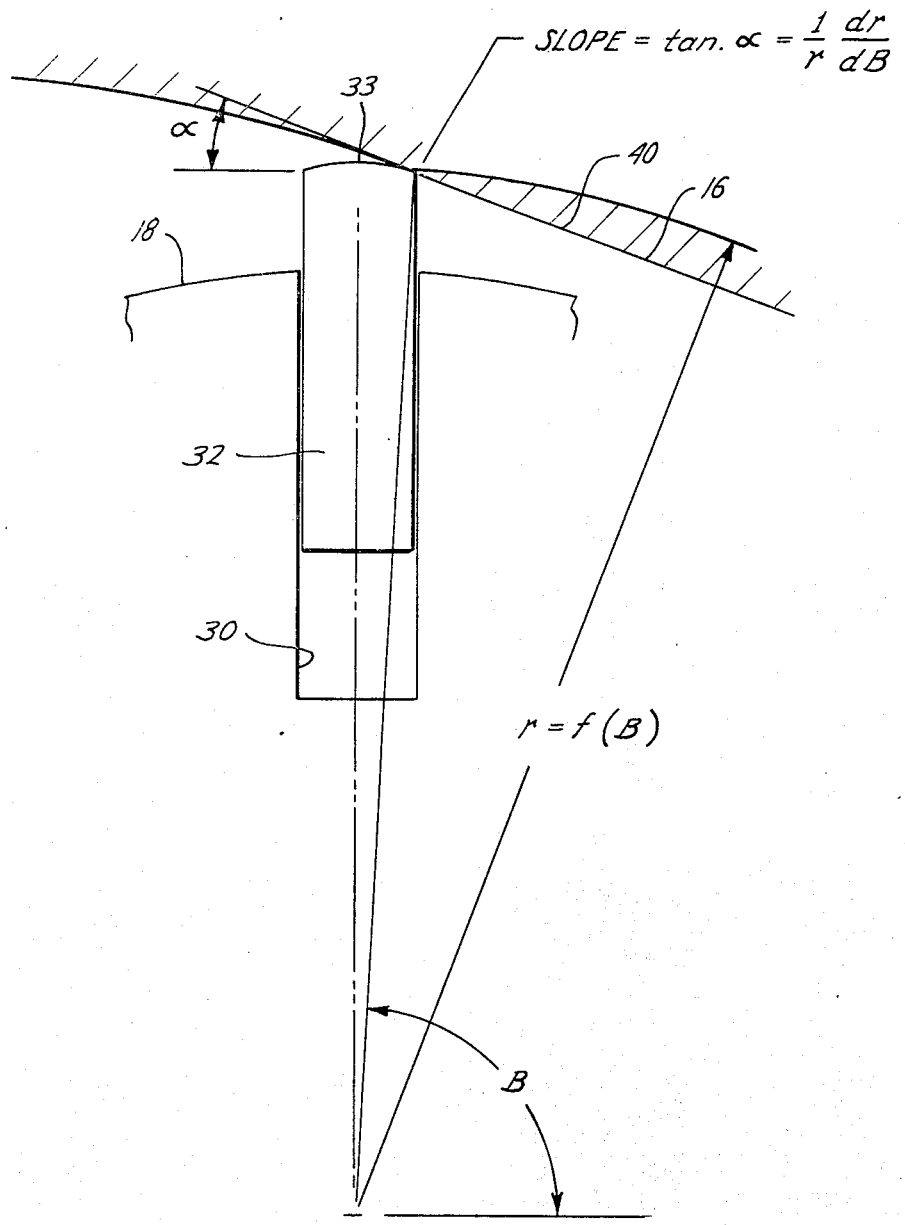
FIG. 5 is an enlarged schematic fragmentary elevational view, in cross section, noting the coaction between the outer edges of one of the vanes of the present invention and its coacting stator periphery.

Vane tips T convexly contoured as described above may provide proper crossing of the rotor and stator vanes in the converter of FIG. 1, but they might have too large a tip radius R to properly ride on the opposing rotor or stator peripheries 16 and 18 without eventual wear damage to the vane tip T and/or the rotor or stator peripheries 16 or 18 particularly when the peripheries are formed by steep curves. FIG. 5 shows a rotor vane 32 with a tip 33 engaged with a stator periphery 16. For proper life of the vane tip 33 and also the periphery 16, it has been found that the outer edge 33 of the rotor vane 32 contour must have a slope equal to, but preferably slightly greater than the maximum slope which occurs anywhere on the stator inner periphery 16. Similarly, the stator vane tip 25 must have an edge slope equal to or preferably greater than the maximum slope occurring on the rotor outer periphery 18. The above conditions are necessary to prevent contact of a vane sharp corner and/or areas of high friction contact with the stator or rotor contours, a condition which produces rapid wearing of the vanes and contours.

As shown in FIG. 5, the minimum vane tip edge slope $\alpha$ is equal to the maximum value of the opposing periphery slope. If we mathematically describe the periphery 16 by the radial distance r from converter axis, then the value of $r$ described in terms of the annular coordinate B, may be generally expressed as $r = f(B)$ where $f(B)$ denotes a functional relationship of $r$ with B. The local value of peripheral slope is equal to the tangent ($\alpha$) where $\alpha$ is the local angle between a line tangent to the surface 33 and a line perpendicular to a radial line $r$, as shown in FIG. 5. Mathematically the slope is given by $$\text{slope} = \text{tangent } \alpha = \frac{1}{r} \frac{dr}{dB}$$

Using the above equation the maximum value of a rotor or stator slope can be found. The edge slope of the corresponding vane tip may then be specified. For the special case of a vane having a portion of a circle as a tip shape, the information in FIG. 4 may be used to find the maximum allowable value of R for a given slope angle $\alpha$.

In summary, it is noted that the rotor and stator vane tips of a fluid converter typified by that of FIGS. 1 and 2 must for proper operation and long life be contoured according to the following rules.

A. To prevent locking of the rotor and stator vanes, the tips must have a convex shape with the sum of the radial extent for both vanes equal to or in excess of the radial clearance between rotor and stator measured adjacent to the vane slots. For reversible operation, the tip contours should be symmetrically shaped, and may as a special case have a contour consisting of a portion of a circle with a radius given by the equation $$R = \frac{t^2}{8F} + \frac{F}{2}$$

where $t$ is the vane thickness and F is the value of tip contour radial extent.

B. To prevent detenting, the radial extent of the convex shape of the stator and rotor vanes should be no greater, respectively, than one fourth the thickness of the stator and rotor vanes.

C. To prevent damage to the vane outer edges and/or the rotor or stator peripheries 16 and 18, the vane edge slope must have a value equal to or slightly exceeding the maximum slope occurring on the opposing periphery. A mathematical method for determining this periphery slope has been described above. Using the above rules, vane tip convex contours may be selected to suit a given design.

As Example 1 of a design using the above method, consider a hydraulic motor of the type shown in FIG. 1 for which the following is initially given:

Rotor with six vanes of thickness $t_2 = 0.062$ inches and a harmonic curve periphery defined by a radial coordinate $r_2$ from the rotor axis, as shown in FIG. 5, wherein the periphery 18 has a pitch diameter of 1.500 inches and a maximum displacement of 0.150 inches and given by $$r_2(B) = \{1.500 - 0.075\,[1 - \cos(6\,B)]\} \text{ inches}$$

Stator with 4 vanes of thickness $t_1 = 0.098$ inches and a harmonic curve periphery defined by a radial coordinate $r_1$ from the axis wherein the periphery has a pitch diameter of 1.505 inches and a maximum displacement of 0.124 inches as $$r_1(B) = 1.505 + 0.062\,[1 - \cos(4B)] \text{ inches}$$

From the above, and previous equations, the maximum rotor slope which dictates the minimum stator vane edge slope, is found to be $$\text{Maximum slope} = \max. \left[\frac{1}{r_2} \frac{dr_2}{dB}\right]$$

$$= \max. \left[\left(\frac{1}{r_2}\right)(0.075)(6)\sin(6B)\right]$$

$$= \frac{(6)(0.075)(1)}{(1.425)} = 0.3158 \text{ inches/inch}$$

The angle corresponding to this maximum slope is $$\alpha_2 = 17.5°$$

Using Rule C, and from FIG. 4, we now determine that a stator vane of thickness $t_2 = 0.098$ inches, and having an edge slope of at least 17.5°, must have a radius no greater than $$R_1 = \frac{T_1}{2\tan(\alpha_2)} = \frac{(0.098)}{(2)(0.3158)} = 0.155 \text{ inches}$$

Similarly, the maximum stator periphery slope, which defines the minimum rotor vane edge slope, is given by $$\text{Maximum stator slope} = \max. \left[\frac{1}{r_1} \frac{dr_1}{dB}\right]$$

$$= \max. \left[\left(\frac{1}{r_1}\right)(0.062)(4)\sin(4B)\right]$$

$$= \frac{(0.062)(4)(1)}{(1.567)} = 0.1583 \text{ inches/inch}$$

The angle corresponding to this maximum slope is $$\alpha_1 = 9.0°$$

Again using Rule C we find that the maximum rotor vane tip radius is equal to $$R_2 = \frac{t_2}{2\tan(\alpha_1)} = \frac{(0.062)}{(2)(0.1583)} = 0.1958 \text{ inches}$$

For the above tentative rotor and stator vane tip radius values, we have radial extent values, computed from the information in FIG. 4, as $$E_1 = R_1 - R_1 \cos\alpha_1$$

$$= 0.155 - 0.155\,[\cos(17.5°)] + (0.155)(1 - 0.9537)$$
$$= 0.0072 \text{ inches}$$

Similarly, we have $$E_2 = R_2 - R_2 \cos\alpha_2$$

$$= 0.1958\,[1 - \cos(9.0°)]$$

$$= (0.1958)(1 - 0.9877) = 0.0024 \text{ inches}$$

Rule A says that the sum of the rotor and stator radial extent values ($E_1 + E_2$) must equal or exceed the rotor to stator radial clearance. From the above we have $$E_1 + E_2 = 0.0072 + 0.0024 = 0.0096 \text{ inches}$$

The radial clearance between rotor and stator peripheries adjacent to the vane slots equals the difference between base dimensions of the contours or $$E = 1.505 - 1.500 = 0.005 \text{ inches}$$

For this example, the use of Rule C to find the vane tip radius values also produced satisfaction of Rule A since the value of $E_1 + E_2$ exceeds E. Furthermore, the use of Rule C also produced satisfaction of Rule B, since the radial extent of the stator vane tip convex shape ($E_1 = 0.0072$ inches) is less than one fourth the stator vane thickness ($t_1 = 0.098$ inches). Also, the radial extent of the rotor vane tip convex shape ($E_2 = 0.0024$ inches) is less than one fourth of the rotor vane thickness ($t_2 = 0.062$ inches).

As Example 2 we will degenerate the rotor contour to a circle as shown in FIG. 2. For this case, no radius is required on the stator vane tip, as determined from Rule C. Hence, the value of $E_1$ is zero. Now, Rule A is no longer satisfied since $E_1 + E_2 = 0.0024$ which is less than the minimum required by Rule A or $E = 0.005$ inches. The stator vane tip must therefore be convexly contoured to give at least an $E_1$ value of $$E_1 = 0.005 - 0.0024 = 0.0026 \text{ inches}$$

This requires a maximum tip radius $R_1$ of $$R_1 = \frac{t_1^2}{8E_1} - \frac{E_1}{2}$$

$$= \frac{(0.098)^2}{(8)(0.0026)} - \frac{(0.0026)}{(2)} = 0.460 \text{ inches}$$

A fluid converter of the type having vanes in the rotor and stator designed as illustrated in these examples and the information given above, will operate without the rotor and stator vanes hanging up on each other, limit detenting, and the vane tip to periphery wear will be acceptable, and the vanes will cross with a minimum disturbance.

The present invention, therefore, is well adapted to carry out the objects and attain the ends and advantages mentioned as well as others inherent therein. While a presently preferred embodiment of the invention has been given for the purpose of disclosure, numerous changes may be made in the details of construction without departing from the spirit and scope of the invention as hereinafter claimed.

What is claimed is:

1. In a fluid power converter having a rotor member and a stator member, the members being rotatable one with respect to the other and having coacting peripheries forming an annular fluid space therebetween, each of the members including a plurality of radially extending vane slots, the improvement in the vanes positioned in each slot comprising, said vanes being generally rectangular in cross section, the outer edges of the vanes which extend into the annular space having a convex curved shape, the convex shape of the stator vanes forms a discontinuous surface with the inner periphery of the stator and the convex shape of the rotor vanes forms a discontinuous surface with the outer periphery of the rotor, the radial extent of the convex shape of the stator vanes plus the radial extent of the convex shape of the rotor vanes being at least equal to the minimum radial clearance between the rotor and stator thereby preventing rotor and stator vanes from catching on each other during rotation, the radial extent of the convex shape of each stator vane being no greater than one fourth of the stator vane thickness, and the radial extent of the convex shape of each rotor vane being no greater than one fourth of rotor vane thickness thereby preventing undesirable detenting between the rotor and stator vanes during rotation, the maximum slope of the convex shape of the rotor vanes being at least equal to the maximum slope of the stator periphery adjacent the annular fluid space, and the maximum slope of the convex shape of the stator vanes being at least equal to the maximum slope of the rotor periphery adjacent the annular fluid space.

2. The apparatus of claim 1 wherein the convex shapes of the rotor and stator vanes are arcs of circles.

3. The apparatus of claim 2 wherein at last one of the said rotor and stator peripheries forming the annular fluid space is a harmonic curve.

4. The apparatus of claim 3 wherein the rotor and stator have a concentric center and the harmonic curve is defined by a radius from said center which is a function of an angle B about the center, the maximum slope of the arc of the circle of the vane engaging said harmonic curve forms a slope angle $\alpha$ and tan $\alpha$ is at least as great as $$\frac{1}{r} \quad \frac{dr}{dB},$$

said vane engaging said harmonic curve has a thickness t and its circular arc convex shape has a radius R whereby $$R = \frac{t}{2 \tan \alpha}$$

and the radial extent F of said vane $F = R - R \cos \alpha$.

* * * * *